US005987889A

United States Patent [19]

Graves et al.

[11] Patent Number: 5,987,889

[45] Date of Patent: Nov. 23, 1999

[54] FUEL INJECTOR FOR PRODUCING OUTER SHEAR LAYER FLAME FOR COMBUSTION

[75] Inventors: Charles B. Graves, Jupiter, Fla.; Clifford E. Smith, Madison, Ala.

[73] Assignee: United Technologies Corporation, Hartford, Conn.

[21] Appl. No.: 08/947,554

[22] Filed: Oct. 9, 1997

[51] Int. Cl.[6] ..... F23R 3/14

[52] U.S. Cl. ..... 60/748; 60/746

[58] Field of Search ..... 60/737, 746, 747, 60/748, 749, 750; 239/400, 405, 406, 463

[56] References Cited

U.S. PATENT DOCUMENTS

| | | | |
|---|---|---|---|
| Re. 30,160 | 11/1979 | Emory, Jr. et al. . | |
| 3,099,134 | 7/1963 | Calder et al. | 60/747 |
| 3,570,242 | 3/1971 | Leonardi . | |
| 3,853,273 | 12/1974 | Bahr et al. . | |
| 3,901,446 | 8/1975 | Petreikis, Jr. . | |
| 3,946,552 | 3/1976 | Weinstein et al. | 60/748 |
| 4,054,028 | 10/1977 | Kawaguchi | 60/749 |
| 4,171,612 | 10/1979 | Zwick | 60/39.23 |
| 4,194,358 | 3/1980 | Stenger . | |
| 4,842,197 | 6/1989 | Simon et al. . | |
| 4,914,918 | 4/1990 | Sullivan | 60/756 |
| 4,991,398 | 2/1991 | Clark et al. . | |
| 5,319,935 | 6/1994 | Toon et al. | 60/737 |
| 5,417,070 | 5/1995 | Richardson | 60/748 |
| 5,603,211 | 2/1997 | Graves . | |

*Primary Examiner*—Ted Kim
*Attorney, Agent, or Firm*—Norman Friedland

[57] ABSTRACT

The fuel nozzle is configured with a fuel injector with a pair of coaxially mounted air swirlers utilized in an annular combustor of a gas turbine engine that is dimensioned to provide 70–90 percent of the mass airflow in the inner passage and the swirl angle of the inner swirler is 45°–55° and the outer swirler is 70° and the L/D of the combustion hole location relative to the fuel injector is 0.6–0.7 which serve to produce an outer shear layer flame for improved lean blowout characteristics.

8 Claims, 3 Drawing Sheets

FUEL INJECTOR FOR PRODUCING OUTER SHEAR LAYER FLAME FOR COMBUSTION

CROSS REFERENCE

This invention relates to the subject matter disclosed in the patent application contemporaneously filed with this patent application by Charles B. Graves, entitled Vane Swirler For Fuel Injector U.S. patent application Ser. No. 09/947,593 identified as Attorney Docket No. F-7772 and commonly assigned to United Technologies Corporation.

TECHNICAL FIELD

This invention relates to fuel injectors for the combustor of gas turbine engines and particularly to means for injecting fuel in the combustion zone for maintaining stable combustion at reduced pressures and fuel air ratios.

BACKGROUND ART

As is well known in the gas turbine engine field of technology, the fuel injector utilized in a combustor of a gas turbine engine typically is mounted in the dome of the annular combustor and is judiciously located in order to assure stable and efficient combustion. The conventional fuel injector includes a fuel nozzle for injecting fuel into the combustion zone of the combustor and a swirler(s) that serves to impart vortical flow to the incoming air in order to create recirculation zones for stabilizing the combustion process. Heretofore types of fuel nozzles typically produce shear layer adjacent to two recirculation zones. The zones are divided into two separate torroidal zones, one being the inner zone and the other being the outer zone. The inner recirculation zone is located near the axis of the injector and the outer zone is located on the periphery of the swirling airflow as it dumps into the combustor. Conventional injectors insert fuel near the axis of the injector, resulting in the flame being held in the inner recirculation zone. A problem with these heretofore types of injectors and swirlers is that the flame being held in the inner recirculation zone is fuel by spray that is centrifuged outboard, thus fuel/air ratio in the inner recirculation zone. This flame-holding mode adversely affects the stabilizing characteristics of the combustion zone. The requirements to stabilize the flame are 1) a recirculation zone that positions hot combustion products near a shear layer and 2) a shear layer that mixes unburned reactants with hot combustion products.

There are a plethora of fuel nozzles that are disclosed in the prior art that include swirlers and injectors for combustors of gas turbine engines and all of which provide recirculation zones for stabilizing combustion. Examples of prior art fuel nozzles are disclosed in U.S. Pat. No. Re. 30,160 reissued in Nov. 27, 1979 and granted to Emory, Jr. et al entitled Smoke Reduction Combustion Chamber, U.S. Pat. No. 3,570,242 granted to Leonardi on Mar. 16, 1971, entitled Fuel Premixing For Smokeless Jet Engine Main Burner, U.S. Pat. No. 4,991,398 granted to Clark et al on Feb. 12, 1991 entitled Combustor Fuel Nozzle Arrangement and U.S. Pat. No. 5,603,211 granted to Graves (a co-inventor of this patent application) on Feb. 18, 1997 entitled Outer Shear Layer Swirl Mixer For a Combustor, all of which are commonly assigned to United Technologies Corporation, the assignee of this patent application. Additional patents of interests are U.S. Pat. No. 3,853,273 granted to Bahr et al on Dec. 10, 1974 entitled Axial Swirler Central Injection Carburator, U.S. Pat. No. 3,901,446 granted to Petreikis, Jr. on Aug. 26, 1975 entitled Induced Vortex Swirler, U.S. Pat. No. 4,194,358 granted to Stenger on Mar. 25, 1980 entitled Double Annular Combustor Configuration and U.S. Pat. No. 4,842,197 granted to Simon et al on Jun. 27, 1989 entitled Fuel Injection Apparatus And Associated Method.

The most relevant of these prior art patents is the U.S. Pat. No. 5,603,211 patent, supra, which discloses a three swirl passage arrangement coaxially disposed relative to the injector. Of significance is that the first and second swirl passage of this design is counter rotating and that the air mass ratio between the first and second passage is 83:17 to 91:9 and the swirl angle of the swirler in creating the counter rotating swirl is in the range of 68° to 75° and the mass of the airflow in the third passage which is co-rotating with the first passage is no greater than 30% of the sum of the mass of the airflows in the first second and third passages (≅15%). By attaining these parameters, the results show that the combustor enhances smoke retardation and relight stability.

This invention addresses the problem of preventing lean blowout of the combustor by providing judicious design and flow characteristics to a dual swirler assembly having discrete swirl angles and mass flow ratios that permit the use of an injector of the pressure atomizing or blast type to operate at lower combustor pressure and lower injector fuel-air ratios. The assembly is limited to a dual passage swirler having an inner swirl passage with approximately a flow angle of 45° to 55° and in the order of 75% of the total fuel nozzle airflow, either being co-rotational or counter-rotational and the length over dome height (L/D) of the combustion air hole location is substantially equal to 0.6 characteristics. In this invention, similar to the disclosure in the U.S. Pat. No. 5,603,211 patent, the prefilm wall discharges fuel near the outer shear layer.

Actual tests of fuel nozzles comparing lean blowouts between the inner shear layer flame of the type in the prior art and the outer shear layer flame as disclosed in this invention, result in the outer shear layer flame producing blowout fuel-air ratios approximately half of the inner shear layer blowout levels. During altitude testing, the blowout pressures for a given airflow were significantly reduced for outer shear layer flames as compared to inner shear layer flames.

DISCLOSURE OF INVENTION

An object of this invention is to provide a fuel injector capable of maintaining stable combustion at lower pressures and lower injector fuel/air ratios than conventional injectors used in gas turbine types of engines.

A feature of this invention is the provision of a pair of concentrically mounted swirler passages relative to the fuel injector where the air flow in the inner swirler passage is at least 50%, but stability performance improves when the flow is up to 85%–90% of the total airflow in both passages; the swirl angle of the air in the inner passage is substantially equal to 42°–57°; the swirl angle of the outer swirler passage is 60°–75°; and the end of the fuel injector is spaced a distance from the first combustion holes in the combustor liner that is substantially equal to 0.6 (non-dimensional) length over dome height (L/D) of the combustor.

Another feature of this invention is the provision of a fuel nozzle that is characterized by directing the fuel to the outer recirculation zone by the selection of parameters of the swirler design that inherently insert the fuel to the outer recirculation zone. These parameters are the number of swirl passages, the direction of the swirl in the passages, the angle of the swirl in the passages and the distance of the fuel injector from the combustion holes in the combustor.

The foregoing and other features of the present invention will become more apparent from the following description and accompanying drawings.

BEST MODE FOR CARRYING OUT THE INVENTION

This invention is related to the technology disclosed in U.S. Pat. No. 5,603,211, supra, which is incorporated herein by reference and discloses the broad concept of improving the blowout characteristics of the fuel nozzle for the annular combustors of gas turbine engines. It is to be understood that the air swirlers in the U.S. Pat. No. 5,603,211 patent serve to locate the point of fuel injection into the outer recirculation zone and is designed to improve smoke reduction created by the combustor and high altitude relight capabilities.

Figure 1:
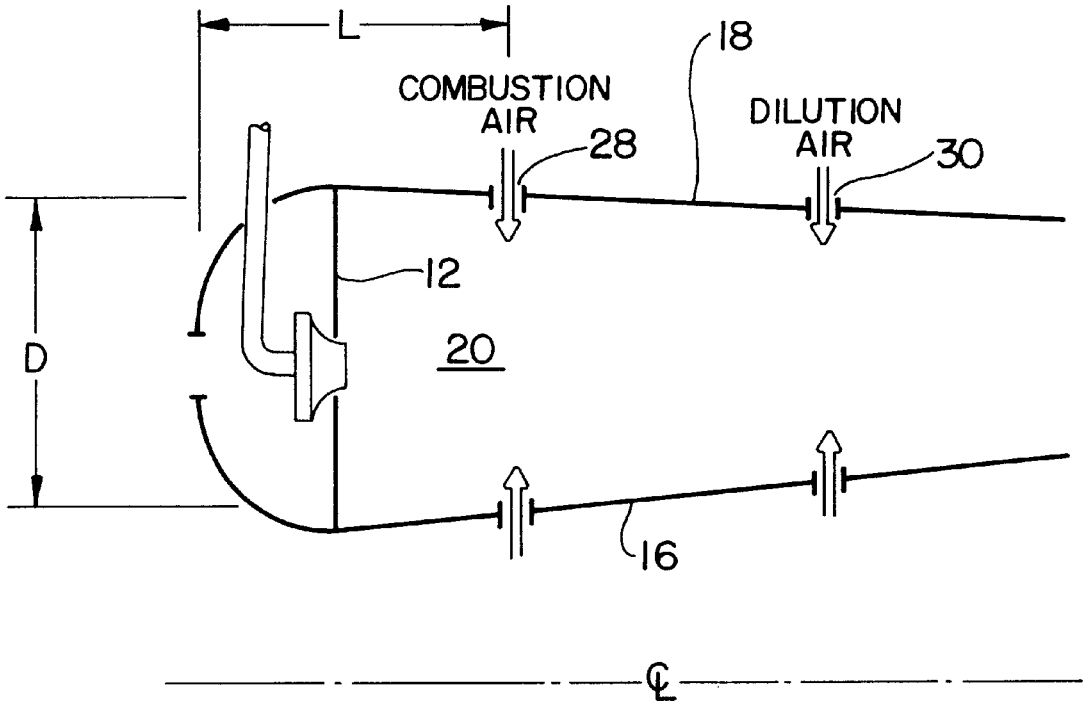
FIG. 1 is a schematic illustration of an annular combustor with the fuel nozzle attached to the dome for injecting fuel to provide the recirculation zones as illustrated and to demonstrate the relationship of the combustion hole to the swirler.
Figure 2:
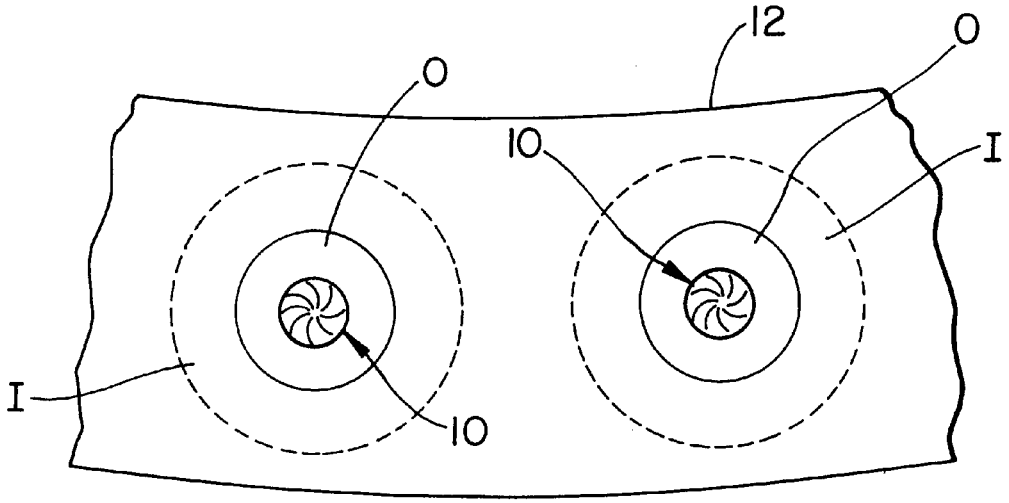
FIG. 2 is a prior art schematic illustration of the end of the dome looking into the inlet of the fuel injectors and illustrating the recirculation zones in the combustion zone of the combustor.
Figure 3:
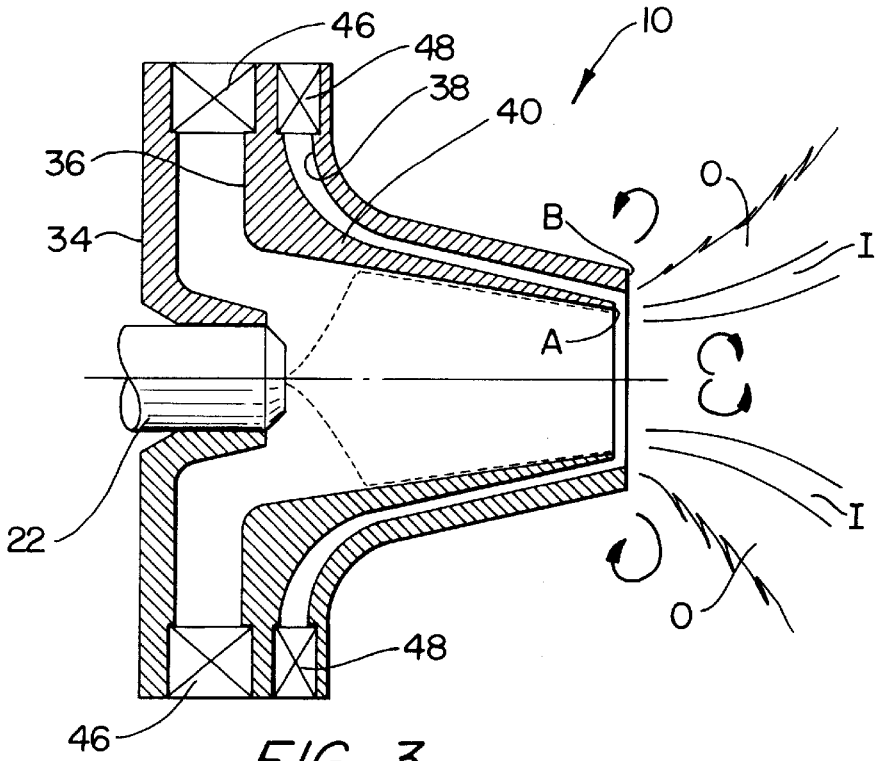
FIG. 3 is a partial view in section illustrating the details of the air swirlers and fuel injectors of the fuel nozzle of the present invention.

This invention is best understood by referring to FIGS. 1–3 which show the fuel nozzle generally indicated by reference numeral 10 mounted in the dome 12 of the combustor 14 of a gas turbine engine (not shown). The combustor is of the annular type that includes an inner annular liner 16 and an outer annular liner 18 defining the combustion zone 20. The dome 12 is affixed to the front end of the combustor liners and encloses this portion of the combustor. The fuel nozzle 10 consists of the fuel injector 22 and the air swirlers 24 and 26 which serve to introduce combustion air and fuel into the combustion zone 20. Additional air is admitted into the combustor via a plurality of circumferentially disposed combustion air radial holes 28 and dilution air holes 30 which are axially spaced relative to each other. The function of the combustion holes and dilution holes are well known in the art and a discussion thereof is omitted for the sake of convenience and simplicity. Suffice it to say that these holes supply additional air to support combustion and maintain a tolerable temperature level in the combustor to assure the integrity of the combustor liners.

In accordance with this invention, a plurality of fuel nozzles 22 and air swirlers 24 and 26 of the fuel nozzle 10 (only one being shown) are circumferentially spaced and judiciously located in the dome of the combustor and are designed to assure that the ratio of the mass air between the air swirlers 24 and 26 maintain a given ratio and that the swirlers provide the desired swirl angle at the discharge end of the swirlers. The fuel nozzle 22 is supported in the fuel nozzle mount plate 34 and may be a simplex configuration and serves to inject fuel in the combustion zone 20 in an axial direction and serves to provide a conical spray. It is contemplated within the scope of this invention that the injector may be either the blast or pressure atomizing type. The swirl passages 36 and 38 are formed by the prefilming wall 40 and the fuel nozzle mount plate 34 and the prefilming wall 40 and the outer wall 42 and are radial passages that fair into axial configuration to introduce the swirling air in a generally axial direction. Radial inflow swirlers 44 and 46 are affixed to the inlet of the passages 36 and 38, respectively for imparting the swirling motion to the air being admitted therein. As is typical in the gas turbine engine the air being admitted into these swirlers is the compressor discharge air that is diffused immediately preceding the admission into the combustor. A portion of this compressor discharge air is utilized to supply the combustion air holes 28 and the dilution air holes 30.

The radial inflow swirlers 44 and 46 are formed with a plurality of radially spaced vanes 50 and 52 that are sized to provide the desired mass flow and swirl angles. The swirl angle at the discharge of each of the passages is obtained by the following formula:

$$\theta = \text{arc tangent } (V_T/V_X)$$

$$V_T/V_X = 2R_V \sin\phi A_e/3R_e A_v$$

where: $R_V$=radius of vane $\phi$=angle of vane

Figure 5:
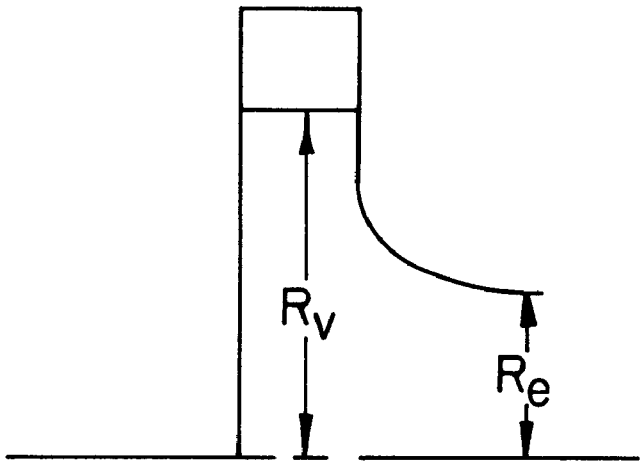
FIG. 5 is a schematic illustration of the vane of the swirler denoting dimensions utilized in the formulae.
Figure 6:
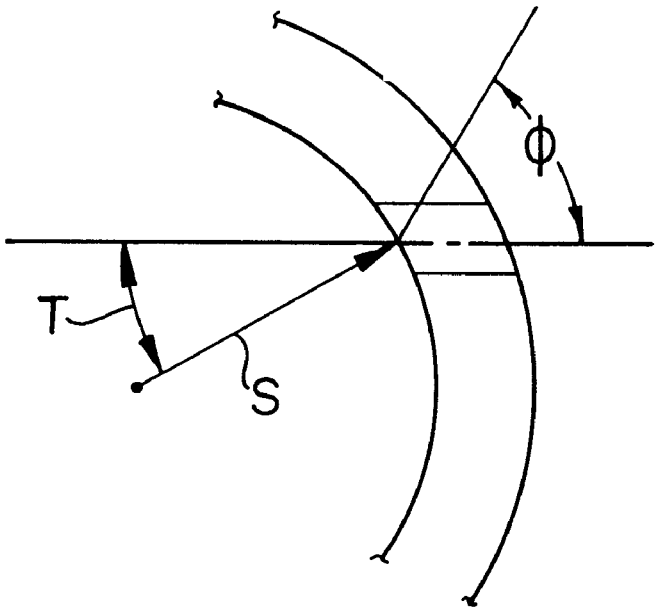
FIG. 6 is a schematic illustration of the vane of the swirler denoting dimensions utilized in the formulae.

Ae=area at the exit of passage $A_v$=area of the vane $R_e$=radius of the exit of passage The area of the vane ($A_v$) is calculated by the formula $A_v$=number of vanes x height of the vane x width of the vane. Ae is $\pi$(pi)$Re^2$ and these symbols are best seen in FIG. 5. The symbols $R_V$ and $\phi$ are demonstrated in FIG. 6 where it will be noted the $\phi$ is the angle between the center of the vane passage (slot between adjacent vanes) and the radius from the centerline to the slot discharge noting that the angle represented by T is $R_V$ sine $\phi$ and the distance $R_V$ is the radius shown as line S.

The definitions used in the above formulae apply to the aerodynamic center line of the flow from the vane and are equally applicable to curved vaned passages as well as straight vane passages.

In the preferred embodiment, the swirl angle $\theta$ of the inner passage 36 at the exit is substantially 45°–55° and the swirl angle $\theta$ of the outer passage 38 at the exit is substantially 70°. The dimensions of the radial swirlers 46 and 48 are selected to admit substantially 70%–90% of the mass airflow in the inner passage 36 and substantially 10%–30% of the mass airflow in the outer passage 38. In addition to these parameters, the distance of the combustion holes is located where the L/D is at least equal to 0.6–0.7. For example, the length equals substantially 2.5 inches –2.8 inches in a 4 inch radial dome height. While the values indicated above have shown to be efficacious, it should be understood in the art that these ranges are not exact values and may vary slightly. The effect can be achieved with a split as low as 50/50 with a recessed prefilmer and higher than 90 and lower than 10 as long as the outer passage is at least 0.030 inch wide. What should be understood by the teachings of this invention is that the fuel droplets which are relatively large when initially injected by the fuel injector and the centrifugal force of the air swirl and the volume of air in the inner passage 36 will drive these fuel droplets to the inner surface of the inner wall 40. This is the prefilming wall. The fuel film proceeds to flow axially along the surface of inner wall 40. The film is then sheared between two high speed airflows at the discharge of passages 36 and 38 resulting in smaller droplets. As these smaller droplets discharge from the passage 36, the selection of the swirl angles is such as to create a high tangential velocity gradient between the swirling flow egressing from the inner passage 36 and outer passage 38. This high tangential velocity gradient serves to induce a large amount of turbulence and provides efficient mixing of the air and fuel at this point and enhances the fuel transport toward the outside of the inner recirculation zone. As will be appreciated by one skilled in this art the fuel is heavier than air and tends to move radially out while the flame is lighter than air and tends to move radially in, in a rotating environment. The tangential velocity of the airstreams in passages 36 and 38 are such that they work together causing the flame to remain outboard of the inner recirculation zone and in the outer recirculation zone where there is a strong interaction between the fuel spray and flame, and thus stabilizing the flame during the operational envelope of the gas turbine engine.

It is apparent from the foregoing that fuel discharged from the fuel injector 22 is centrifuged to the prefilming wall by the swirling of the inner airflow in the passage 36. The fuel injector is immersed relative to the discharge to insure that the fuel substantially reaches the prefilmer. As one skilled in the art will recognize, the selection of parameters will be dependant on the particular application and that the actual value is a function of the nozzle spray angle, the prefilming diameter, and the nozzle pressure drop or other like parameters that are typically used by the fuel nozzle designer. As the fuel streams to the prefilming wall 40 in a configuration that is in the form of a sheet at the exit, the inner and outer airflows discharging from passages 36 and 38 shear the film into fine droplets. By virtue of the fuel entering the combustion zone in this manner, the prefilmer wall discharges fuel near the shear layer adjacent the inner recirculation zone I and the outer recirculation zone O and the inner flow angle is sufficiently low so that the fuel will concentrate in the outer recirculation zone. This compares with conventional fuel nozzle designs of air blast injectors where 5%–30% of the airflow is inboard of the fuel film.

Figure 4:
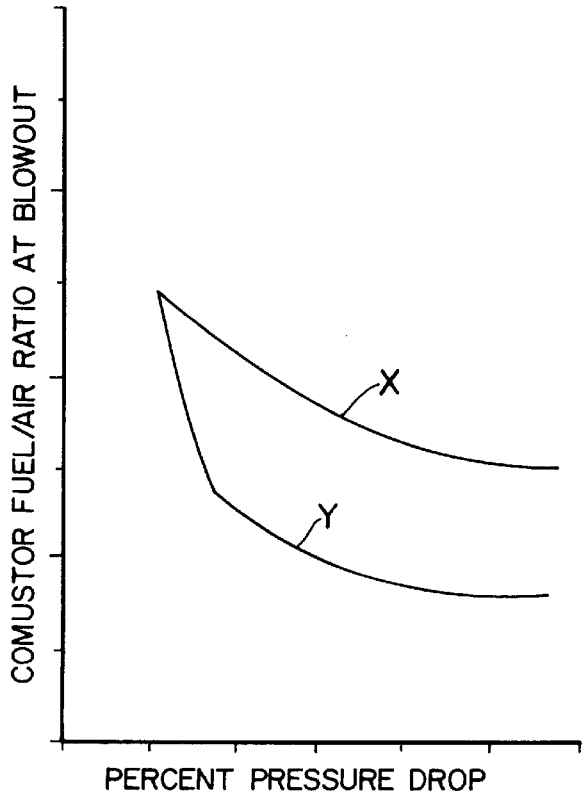
FIG. 4 is a graphical representation of percentage of pressure drop versus combustion fuel/air ratio at blowout for comparing the blowout characteristics of fuel injection into the inner recirculation zone and the outer recirculation zone.

FIG. 4 demonstrates the results of an actual test that compared lean blowouts of the inner recirculation zone of the prior art configuration and the outer recirculation zone as taught by this invention at ambient conditions. A single injector was utilized for these tests. As is evident from the drawing where the curve X represents the results where the fuel injector configuration injected fuel into the inner recirculation zone and curve Y represents the configuration where the injector injected fuel into the outer recirculation zone. It is apparent from FIG. 4 which is a plot of the percentage of the air pressure drop along the abscissa axis versus the combustor fuel/air ratio at blowout along the ordinate axis that the curve Y (outer recirculation flame) provided better blowout characteristics than curve X, it being noted that the curve closer to the abscissa axis is desirable as it illustrates better blowout characteristics.

In additional testing that was done in an altitude chamber which duplicates the actual altitude an aircraft would encounter, using a four nozzle sector combustor, the blowout pressures for a given airflow were significantly reduced for flames propagated in the outer recirculation zone compared to flames in the inner recirculation zone.

What has been shown by this invention is means for designing an efficacious fuel nozzle that has proven enhanced low blowout characteristics. Another aspect of this design philosophy is that the stability is essentially governed by the outer passage airflow while smoke production is governed by the total fuel nozzle airflow. Thus, by maintaining delta pressure of the airflow, the inner passage airflow can be increased to address smoke requirements with the proviso that the exit diameter has not grown so large that the fuel can no longer substantially reach the prefilmer wall.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A fuel nozzle for an annular combustor for a gas turbine engine, said annular combustor having an inner liner and an outer liner coaxially disposed relative to each other and including a fore end for defining a combustion zone, a dome interconnecting said inner liner and said outer liner at said fore end sealing off one end of said combustor, said fuel nozzle affixed to said dome and comprising a fuel injector and a first swirler having first wall means defining a first passage having an inlet and an outlet and a second swirler having second wall means defining a second passage having an inlet and outlet and being disposed concentrically relative to each other and coaxially relative to said the fuel injector, said fuel injector for injecting fuel into said first passage, the improvement comprising swirl means at the inlet of said first passage of said first swirler for admitting a given quantity of airflow and imparting a given swirl thereto, additional swirl means at the inlet of said second passage for admitting a given quantity of airflow and imparting a given swirl thereto, said first wall means defining a prefilming surface, said fuel and said given quality of air and the direction of swirl of said swirl in said first passage being directed to said prefilming surface, the given swirl and airflow discharging from sad outlet in said first passage and the given swirl and airflow discharging from the outlet of said second passage being selected to define an outer recirculation zone in said combustion zone located radially outwardly disposed relative to said outlet of said second passage so that the discharge of the airflows from the outlet of said first passage and the outlet of said second passage causes said fuel and air to mix and flow radially outward relative to the axis of said fuel injector and into said recirculation zone for stabilizing the flame and said fuel injector being axially spaced a predetermined distance from radial combustion holes formed in said inner liner and said outer liner of said combustor whereby the lean blowout characteristics of said combustor are enhanced.

2. An improvement as claimed in claim 1 wherein said axial distance between the fuel injector and said combustion holes bears a relationship to dome height and length of the axial displacement between an end of the fuel injector and center lines of the combustion holes (L/D).

3. An improvement as claimed in claim 2 wherein said L/D equals substantially between 0.6 and 0.7.

4. An improvement as claimed in claim 3 wherein said first swirler includes a plurality of vanes and vane passages between adjacent vanes and each vane includes a discharge end and the swirl angle of said first passage exit is substantially equal to 45°–55° where the swirl angle is the angle between the center of one of said vane passages and the radius from the centerline to said discharge end.

5. An improvement as claimed in claim 3 wherein the mass flow of said air being admitted into said first passage is substantially equal to 70%–90% of the total flow being admitted into said combustion zone from said first passage and said second passage.

6. An improvement as claimed in claim 5 wherein the mass flow of air admitted into said second passage is substantially equal to 30%–10% of the total mass flow of air being admitted to said first passage and said second passage.

7. An improvement as claimed in claim 5 wherein the swirl angle of said second passage substantially equals 70°.

8. An improvement as claimed in claim 1 wherein said swirlers are radial inflow.

* * * * *

UNITED STATES PATENT AND TRADEMARK OFFICE

CERTIFICATE OF CORRECTION

PATENT NO. : 5,987,889

DATED : November 23, 1999

INVENTOR(S) : Graves et al

It is certified that error appears in the above-identified patent and that said Letters Patent is hereby corrected as shown below:

On the title page,

After the title insert --This invention was made under contract and the U.S. Government has interest herein.

In claim 1, line 35 change "quality" to --quantity-- and on line 37 change "sad" to --said--

Signed and Sealed this

Ninth Day of May, 2000

*Attest:*

Q. TODD DICKINSON

*Attesting Officer*

*Director of Patents and Trademarks*